US005652407A

United States Patent [19]

Carbone

[11] Patent Number: 5,652,407

[45] Date of Patent: Jul. 29, 1997

[54] NON-LETHAL AMMUNITION AND METHOD

[75] Inventor: Alfred Vincent Carbone, Londonderry, N.H.

[73] Assignee: Academy of Applied Science, Concord, N.H.

[21] Appl. No.: 600,621

[22] Filed: Feb. 13, 1996

[51] Int. Cl.[6] ..... F42B 5/03; F42B 8/12

[52] U.S. Cl. ..... 102/438; 102/444; 102/502; 102/512; 102/513

[58] Field of Search ..... 102/430, 435, 102/439, 444, 446, 447, 502, 512, 513, 529

[56] References Cited

U.S. PATENT DOCUMENTS

| | | | |
|---|---|---|---|
| 368,924 | 8/1887 | Kruger | 102/438 |
| 588,764 | 8/1897 | Boss | 102/438 |
| 703,839 | 7/1902 | Scott | 102/438 |
| 3,031,966 | 5/1962 | Metzger | 102/513 |
| 3,326,133 | 6/1967 | Stadler | 102/529 |
| 3,732,821 | 5/1973 | Royer | 102/502 |
| 3,865,038 | 2/1975 | Barr | 102/502 |
| 4,656,947 | 4/1987 | Gordon et al. | 102/502 |
| 5,035,183 | 7/1991 | Luxton | 102/502 |
| 5,295,439 | 3/1994 | Carbone | 102/502 |

FOREIGN PATENT DOCUMENTS

| | | | |
|---|---|---|---|
| 7686 | 11/1899 | Norway | 102/438 |
| 553823 | 6/1943 | United Kingdom | 102/444 |
| 2172969 | 10/1986 | United Kingdom | 102/467 |
| 2220467 | 1/1990 | United Kingdom | 102/447 |
| WO95/00815 | 1/1995 | WIPO | 102/502 |

*Primary Examiner*—Harold J. Tudor
*Attorney, Agent, or Firm*—Rines and Rines

[57] ABSTRACT

A non-lethal incapacitating ammunition round and technique is disclosed using a bundle of adjacent flat-faced resilient cylindrical projectile plugs that, after firing, are set into tumbling motion in various orientations to slap and bruise the skin of a human or animal target at multiple locations of the body, with and without the simultaneous delivery of dye marking or subduing substances.

14 Claims, 4 Drawing Sheets
(2 of 4 Drawing(s) in Color)

Figure 1:
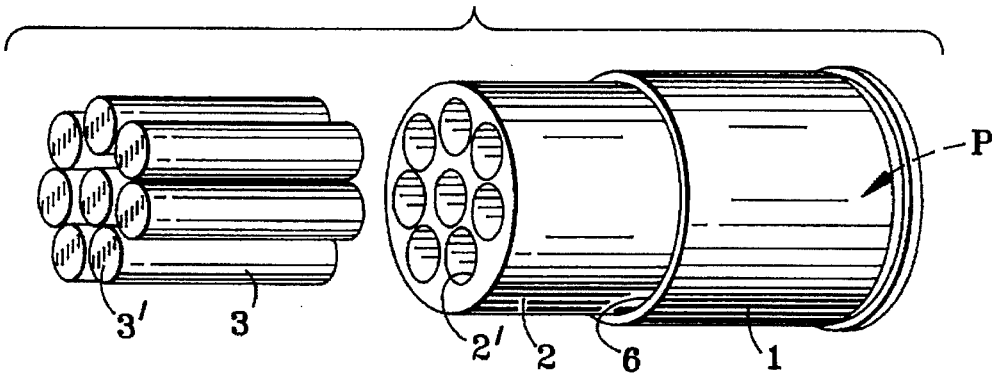

| |
|---|
| FIG. 6A |
| FIG. 6B |
| FIG. 6C |

NON-LETHAL AMMUNITION AND METHOD

The present invention relates to non-lethal incapacitating powder-discharge-driven ballistic ammunition rounds and the like, being more particularly, though not exclusively, directed to bullets or cartridges specifically adapted to provide non-lethal stopping power and to methods or techniques underlying the same.

BACKGROUND

The art is replete with many types of ammunition designed for a wide variety of uses and effects, ranging in the case of hand held guns, from hard lead to even steel pointed penetration projectiles and to multiple bursting projectiles such as shot gun pellets on the one hand, and so-called "Glaser" rounds for penetration and the tearing of lethal holes in the target recipient, on the other hand. In all such devices, the approach is to employ a rather slow-burning powder to create the required gas expulsion pressure in the cartridge or shell casing to generate a muzzle velocity necessary to launch and carry the hard metal projectile(s), packed in the cartridge, to the target for the intended penetration and, most often, lethal effects.

Emphasis in both police and military applications, moreover, has been also directed to developing aiming expertise, with the particular end view of hitting a precise spot behind which lies an organ or other body part that the bullet is to enter or where the projectile(s) should burst in order to kill the recipient. Successive rounds are provided in revolvers and semi-automatic and automatic weaponry to enable multiple firings that may insure the ultimate result if the first projectile fails to achieve its goal. Such conditions are described, for example, in an article entitled "Accurately Predicting Stopping Power" appearing in Guns Magazine, 1992.

There are occasions and circumstances, however, including personal or home self-defense, as well as in police, military and other uses, where society generally deems it preferable to achieve the stopping or disabling of an attacker or other threatening individual, without inflicting a likely lethal result, and with low inflicted collateral damage, and, most desirably, with greatly reduced ricochet potential. My earlier U.S. Pat. No. 5,295,439 addresses some of these objectives through providing minimally penetrating multiple pellets in single cartridges for non-lethally stopping single individuals.

There are, however, situations where many individuals must be simultaneously stopped. In particular, the need for such non-lethal stopping power is desirable during riots where hundreds or thousands of people must be brought under control with non-lethal means. A weapon which can disperse a number of projectiles into a crowd of people without inflicting lethal results and yet incapacitating them by knocking them down without severe damage would be a very useful weapon for police and security personnel to possess. Another use for such a weapon is in the protection of government and other buildings and institutions and areas where the general public or even occupants might become unintentional recipients of a lethal projectile during the course of an intrusion.

It is to such applications that the present invention is in large measure primarily directed, having also the concomitant synergistic effects of reducing both the required aiming skills and the number of bullets that must be carded in the weapon and potentially fired, and with ricochet damage minimization.

OBJECTS OF INVENTION

An object of the present invention, accordingly, is to provide a new and improved incapacitating and generally non-lethal ballistic round and method of limiting striking collateral damage effects thereof, particularly suited for such applications as the control of riots or crowds and the like.

A further object is to provide a novel cartridge embodying multiple projectiles designed in consort with the expelling powder-generated gases to insure the limitation of the degree of penetration of the projectiles upon striking the recipient or other target, and to provide multiple striking points over a limited controlled region or lateral space distribution or area—such multiple entries also eliminating the necessity for both precise aiming skills and for multiple firings otherwise required in conventional singly fired projectile operation.

Other and further objects will be explained hereinafter and are more particularly delineated in the appended claims.

SUMMARY

In summary, however, from one of its viewpoints, the invention embraces an incapacitating non-lethal multiple projectile powder-driven ammunition round having, in combination, a cylindrical casing rearwardly containing a powder charge and forwardly a cylindrical pod fixed to the casing and having a plurality of closely adjacent parallel cylindrical bores therethrough, each bore containing a closely fitting resilient cylindrical projectile extending therethrough.

Preferred and best mode designs and construction and techniques of operation are later described in detail.

DRAWINGS

The file of the patent contains at least one drawing executed in color. Copies of this patent with color drawing(s) will be provided by the patent and Trademark Office upon request and payment of the necessary fee.

Figure 2:
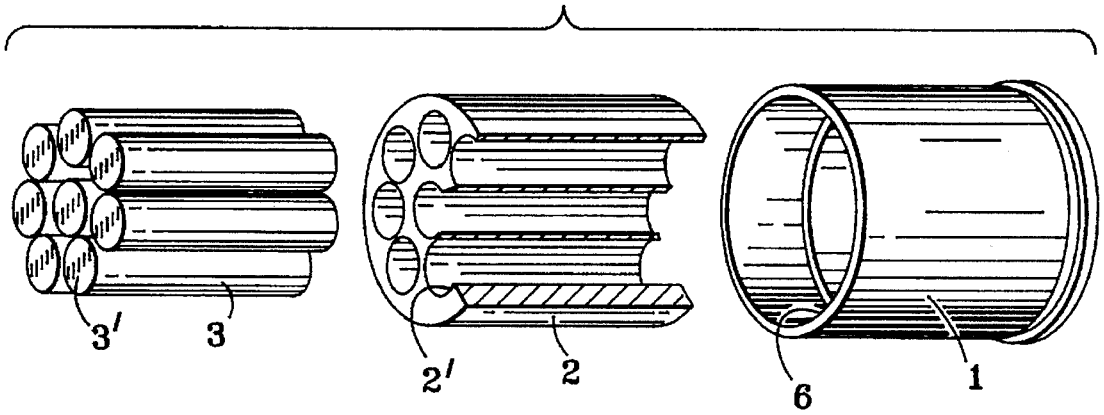
Figure 3A:
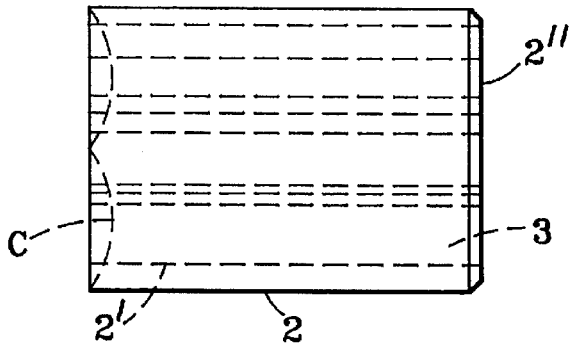

The invention will now be described in connection with the accompanying drawings;

FIG. 1 of which is an isometric view of a cartridge and its cylindrical projectiles shown prior to insertion into the pod and constructed in accordance with the present invention;

FIG. 2 is an exploded cut-away isometric drawing of the bullet and cylindrical projectiles;

FIGS. 3A and B are respectively side and end views showing the holding of the cylindrical projectiles;.

Figure 4A:
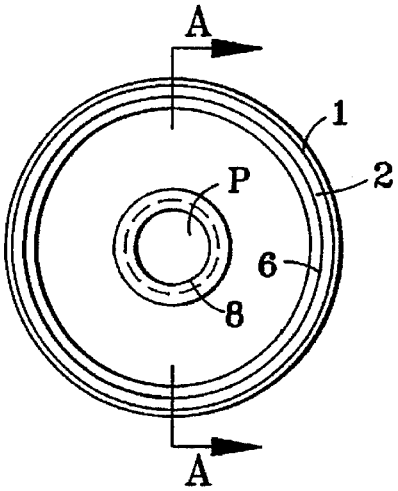
Figure 5A:
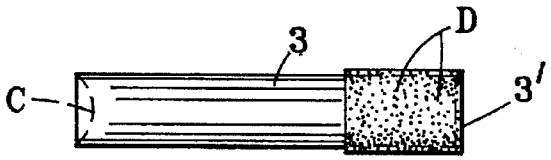
Figure 5B:
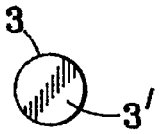
Figure 6A:
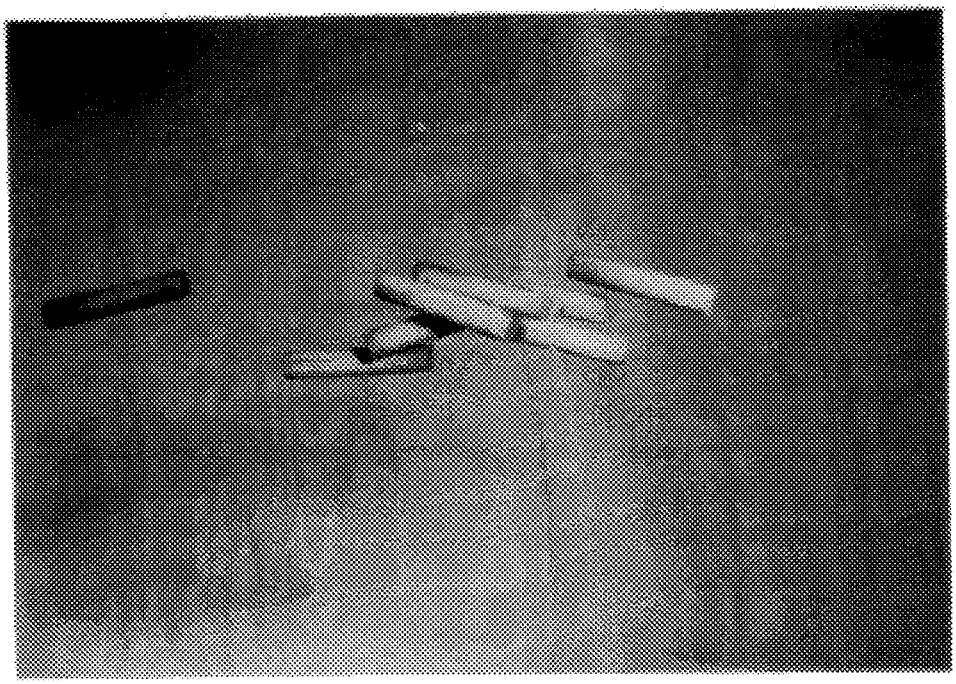
Figure 6B:
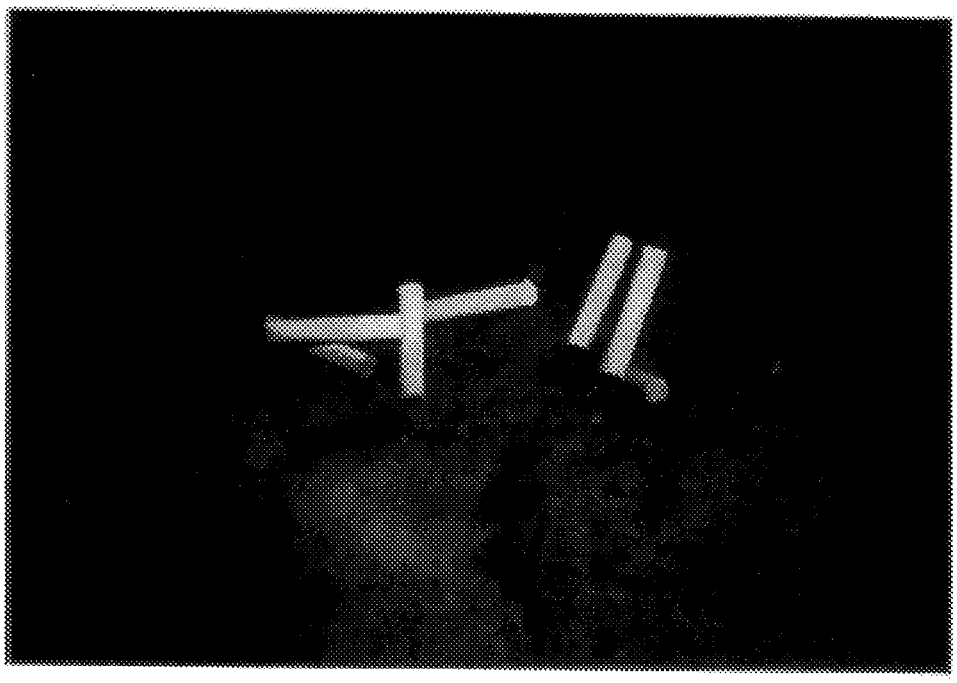
Figure 6C:
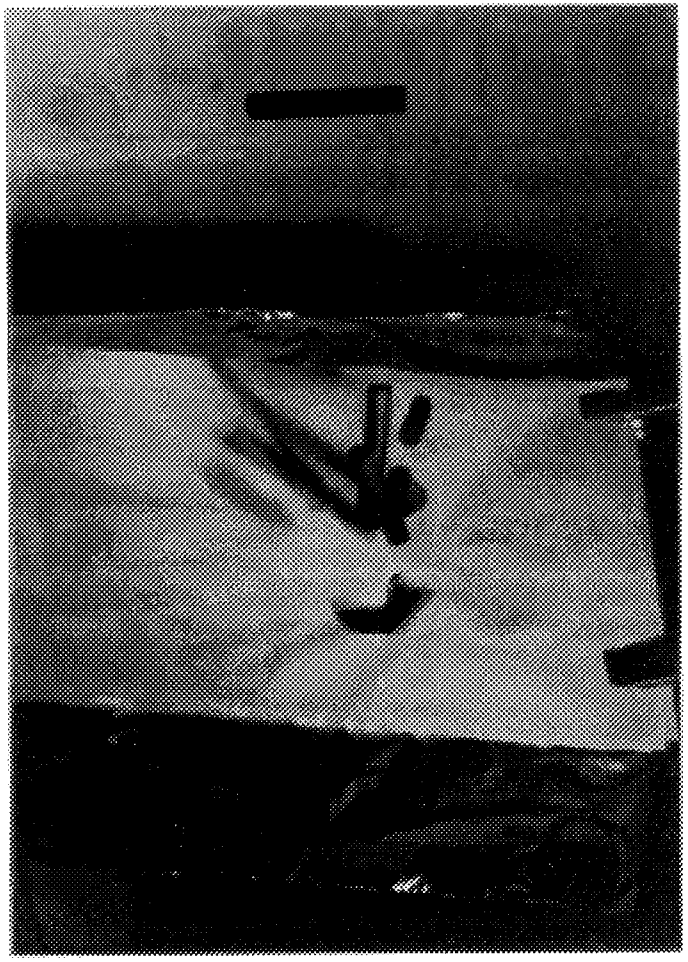

FIGS. 4A and B are respectively end and longitudinal section views (the latter along the transverse line looking in the direction of the arrows A of FIG. 4A), of the powder charge casing;

FIGS. 5A and B illustrate side and end views of one of the cylindrical projectiles; and FIGS. 6A, 6B and 6C are photographs of the multiple projectiles in actual flight.

PREFERRED EMBODIMENTS

Referring to the drawings, FIGS. 1 and 2 illustrate a preferred mode of design of a cylindrical cartridge or shell casing I conventionally containing a rearward powder charge P, more full illustrated in FIGS. 4A and B, and supporting a cylindrical pod 2 extending forwardly and provided with an array of substantially contiguous or closely adjacent similar parallel cylindrical bores or cells 2' longitudinally extending parallely therethrough for receiving or housing a corresponding parallel array or circular bundle of substantially contiguous or closely adjacent similar parallel cylindrical plug projectiles 3 as of resilient plastic, later more fully described.

Figure 3B:
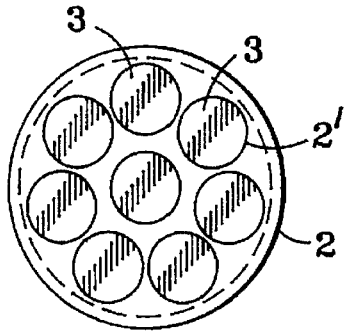
Figure 4B:
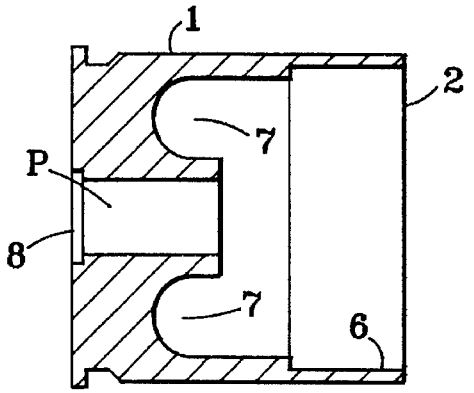

The pod 2 is preferably permanently attached to the casing 1, being received and locked in the open case end in a recessed seat 6, FIGS. 4A and 4B, in front of the low pressure chamber 7 surrounding the powder charge compartment P. The projectiles 3 are closely fitted within the pod bores or cells 2' as in FIGS. 3A and 3B, showing an exemplary circular circumferential array surrounding a central unit. When the firing pin of the weapon (not shown) strikes the primer pin 8 of the powder charge P, the expanding gas from the discharge fills the chamber 7 and propels the circular bundle of plug projectiles 3 simultaneously and side-by-side out of the pod 2 and through the weapon muzzle (not shown) toward the target.

Preferred plug projectiles, as previously stated, are of resilient plastic material as of rubber or other elastomeric polymers, including PVC of about 70–85 Durometer shore A hardness, and, as shown more particularly in FIGS. 3A and 5A, are of substantially the full length of the pod bores or cells 2' and preferably slightly concaved at their inner ends C facing the powder charge for the purpose of increasing the efficiency of transferring the expulsion energy to the projectile plugs. The outer ends 3' of the projectiles are preferably substantially flat or planar as shown, to provide the type of trajectories, tumbling, (FIG. 6B), and target striking characteristics (FIG. 6C) desired for the particular purposes of the invention and now to be described.

In accordance with the invention, when the charge P is detonated, the array of circular projectile plugs 3 is expelled from the pod 2 with an exit velocity preferably of the order of about 250–300 feet per second toward the target. Upon leaving the weapon, the resilient cylindrical plug projectiles start gradually and limitedly to disperse (FIG. 6A) and, at about 10 feet from the muzzle, commence tumbling and in an irregular pattern and orientation, FIG. 6B, striking targets in their path at multiple points, FIG. 6C, at ranges up to the order of about 150 feet; some head-on and others broadside, flipping and slapping, bruising and welting the skin at multiple points of human and animal targets—but not penetrating or materially penetrating the skin. The effect imparted to the skin, however, will be painful and at multiple points substantially simultaneously, but not lethal or fatal. Depending upon the range, this may knock the human or animal target down.

Where desired, moreover, a dye marker impregnated in, coated on or carried by the projectiles may be simultaneously delivered to identify the target at a later date; or, subduing substances such as pepper-like materials, teargas (CN), etc. may similarly be incorporated, and in addition, where slight skin puncture is desired, sedating subduing or other chemicals such as DMSO may also be provided—all these being schematically represented at D in FIG. 5A.

The ammunition of the invention is thus especially tailored for providing creditable knock-down stopping or incapacitating power, but with minimum if any penetration, and thus reduced collateral and generally non-lethal damage. This particular type and configuration of multiple projectiles of the invention, moreover, develops a fast hydrostatic shock by making multiple wounds over a controlled region of dispersion of the striking projectiles without over-penetration, such as to incapacitate, rather than destroy, the human or animal target.

As a result of the novel density, shape and velocity combination underlying the invention, moreover, the multiple initially in-line projectile bundle discharge is followed by a rapid loss of speed and ultimately harmless dropping to the ground over a relatively short distance beyond the desired range, such as that of the typical indoor or outdoor confrontational ranges over which accuracy is excellent. If, on the otherhand, a target is intercepted, there is rapid spending of energy on impact of the relatively soft and resilient plastic projectiles. Ricochet is therefore substantially eliminated and minimum firing recoil occurs-providing safety features for street use and for self-defense purposes, particularly. To this is added the benefit of having multiple impacts upon the target each time the gun trigger is pulled. This, as previously pointed out, not only reduces the necessity for precise aiming, but minimizes the amount of ammunition and separate firings required to stop a target.

Most successful applications, the flight effects of which are shown in before-referenced FIGS 6A–6C employed eight rubber-like projectiles of the order of 70–85 Durometer (Shore A) hardness, each about 0.375 of an inch in diameter, and about 2.125 inches long, closely fitted within eight equally circumferentially spaced bores 2' about ⅜ inch in diameter (just slightly greater than the projectile diameter) on a 0.920 inch circle and in a 1.5 inch diameter pod 2, about 2.125 inches in length, fitted within a 40mm shell casing 1, as shown in FIGS. 4A and 4B. For these successful tests, the concavities C at the projectile inner ends had a radius of 0.535 inch and a depth of 0.125 inch, FIGS. 3A and 3B, and, in addition, a front surface pod chamfer 2", FIG. 3A, of 0.031×0.031 inch. Clearly, scaling for other size ammunition is readily feasible.

While the technique, approach and discoveries underlying the invention have been described with reference to a handheld launching and semi-automatic and automatic rounds, such are more generally applicable to other types of munitions; as well, wherever the features attainable with the invention may be desired.

To obtain special effects, moreover, some of the projectiles may be somewhat varied in length or weight, though substantially similar projectiles have been found to be desirable for the described performance. For biodegradable purposes, the casing and/or pod may be made of paper and the like; and for special projectile diverging or converging effects, the bores 2' may be correspondingly tapered or non-parallel.

Further modifications will also occur to those skilled in this art, such being, therefore,considered to fall within the spirit and scope of the invention as defined in the appended claims.

What is claimed is:

1. An incapacitating non-lethal multiple projectile powder-driven ammunition round having, in combination, a cylindrical casing rearwardly containing a powder charge and forwardly a cylindrical pod fixed to the casing and having a plurality of closely adjacent parallel cylindrical bores therethrough, each bore containing a closely fitting resilient cylindrical projectile plug extending therethrough, each cylindrical projectile plug having a length substantially equal to a length of a corresponding bore.

2. A round as claimed in claim 1 and in which the forward ends of the projectile plugs are substantially flat.

3. A round as claimed in claim 1 and in which the rearward ends of the projectile plugs are substantially concave.

4. A round as claimed in claim 1 and in which a circumferential array of substantially contiguous bores is provided in the pod.

5. A round as claimed in claim 4 and in which the diameters of the bores is such as to permit the inclusion of a similar central bore within the array.

6. A round as claimed in claim 1 and in which the pod is chamfered around its outer end.

7. A round as claimed in claim 1 and in which a gas expansion chamber is provided within the casing between the powder charge and the pod.

8. A round as claimed in claim 2 and in which the projectiles are rubber elastomeric polymer plugs.

9. A round as claimed in claim 1 and in which the pod is attached to the casing within an inner recess seat in the forward end of the casing.

10. A round as claimed in claim 9 and in which at least one of the casing and the pod is of biodegradable material including of paper construction.

11. A round as claimed in claim 1 and in which the round is a 40mm round, the pod is about 2.125 inches in length and 1.5 inches in diameter and is provided with bores each about 0.375 inch in diameter.

12. A round as claimed in claim 11 and in which eight bores with corresponding projectile plugs are provided, seven formed substantially contiguously circumferentially about the pod and the eighth centrally thereof.

13. A round as claimed in claim 12 and in which the rearward end of each projectile plug is concaved a distance of about 0.125 inch.

14. A round as claimed in claim 1 and in which the projectile plugs carry one of marking and subduing substances.

* * * * *